US009464401B2

(12) United States Patent
Gorlov

(10) Patent No.: US 9,464,401 B2
(45) Date of Patent: Oct. 11, 2016

(54) SYSTEM FOR PREVENTING WATER INFILTRATION INTO A SUMP

(76) Inventor: Sergei Gorlov, Pittsburgh, PA (US)

( * ) Notice: Subject to any disclaimer, the term of this patent is extended or adjusted under 35 U.S.C. 154(b) by 757 days.

(21) Appl. No.: 13/224,400

(22) Filed: Sep. 2, 2011

(65) Prior Publication Data

US 2012/0055928 A1 Mar. 8, 2012

Related U.S. Application Data

(60) Provisional application No. 61/379,447, filed on Sep. 2, 2010.

(51) Int. Cl.
*B65D 45/32* (2006.01)
*E02D 29/14* (2006.01)

(52) U.S. Cl.
CPC ..... *E02D 29/149* (2013.01)

(58) Field of Classification Search
USPC ..... 220/320, 371–372, 367.1, 219–220, 220/253, 484, 366.1
See application file for complete search history.

(56) References Cited

U.S. PATENT DOCUMENTS 2,359,416 A 10/1944 Hammeren
3,972,440 A * 8/1976 Warren ..... 220/484
4,655,361 A * 4/1987 Clover et al. ..... 137/363
4,717,036 A * 1/1988 Dundas et al. ..... 220/484
5,111,955 A * 5/1992 Baker et al. ..... 220/303
5,535,910 A 7/1996 Cassel
5,832,673 A 11/1998 Cho
7,171,994 B1 2/2007 O'Brien
2008/0017644 A1 1/2008 Wickland et al.

OTHER PUBLICATIONS

United States Patent and Trademark Office, "International Search Report and Written Opinion", Feb. 9, 2012, 7 pp.

* cited by examiner

*Primary Examiner* — Anthony Stashick
*Assistant Examiner* — James M Van Buskirk
(74) *Attorney, Agent, or Firm* — Eckert Seamans Cherin & Mellott, LLC; Stephen A. Bucchianeri

(57) ABSTRACT

A system for preventing liquid infiltration into a sump having an opening defined by a sump collar includes a ring member adapted to be disposed about the sump collar, at least a portion of the ring member adapted to be in contact with a drainable material disposed below. The system also includes a lid member in engagement with the ring member. The ring member including a number of apertures disposed therein, each aperture of the number of apertures being adapted to allow liquid to pass from a top surface of the ring member to the drainable material below.

6 Claims, 5 Drawing Sheets

Prior Art

SYSTEM FOR PREVENTING WATER INFILTRATION INTO A SUMP

CROSS REFERENCE TO RELATED APPLICATIONS

This application claims priority to U.S. provisional application No. 61/379,447 filed Sep. 2, 2010, entitled "System for Preventing Water Infiltration into a Sump", the contents of which are incorporated herein by reference.

FIELD OF THE INVENTION

The invention relates generally to sump systems used in gasoline service stations. More particularly, the invention relates to a system for preventing the infiltration of water in a sump.

BACKGROUND INFORMATION

Service stations which dispense gasoline and other fuels to automobiles typically utilize large tanks buried underground beneath such service stations from which the gasoline is dispensed. Such tanks require pumping systems which are also typically buried underground in isolated compartments, or sumps, near the storage tanks. In order to be able to inspect and service such pumping systems, the compartments in which they are housed are provided with large hatches, or lids, that are generally disposed at or about ground level, typically in the concrete surface near the gasoline pumps and parking lot of the service station. FIG. 1 shows a schematic cross-sectional view of an example upper portion of a perimeter portion of a prior art sump and access lid.

Referring to FIG. 1, the sump, shown generally at A, is formed from generally vertical walls 10 having a metal ring 12 disposed at the top. When initially installed, the sump is typically backfilled with gravel 14 capped by a layer 16 of concrete, which forms the surface upon which vehicles using the service station travel. In order to avoid interference with vehicles travelling on the concrete, the metal ring 12 is typically disposed at roughly the same elevation as the top surface 18 of the surrounding concrete. In order to protect the contents of the sump, a metal lid 20 sits generally on a recessed ledge 22 within the metal ring 12, thus placing the top 24 of the lid 20 roughly at the same elevation as the metal ring 12 and surrounding concrete 16. A drawback to such arrangement is that water on the surrounding concrete, such as rainwater, commonly enters the sump by way of the seam (not numbered) between the sump lid 20 and the metal ring 12. Such water can accumulate in the sump and lead to corrosion of the metal piping and other equipment located in the sump. Such corrosion creates a potential fuel release problem which presents a danger to persons nearby as well as a long term environmental concerns.

Accordingly, there exists a need for an improved sump design that allows human access while preventing water infiltration.

SUMMARY OF THE INVENTION

The present invention addresses deficiencies in the art by providing a system for preventing liquid infiltration into a sump having an opening defined by a sump collar. The system comprises a ring member that is adapted to be disposed about the sump collar. At least a portion of the ring member is adapted to be in communication with a drainable material disposed below when the ring member is disposed about the sump collar. The system further comprises a lid member in engagement with the ring member. The ring member includes a number of apertures disposed therein, each aperture of the number of apertures is adapted to allow liquid to pass from a top surface of the ring member to the drainable material below.

Each aperture of the number of apertures may be disposed in a portion of the ring member radially outward from the lid member.

The lid member may comprise a downward extending lip that cooperatively engages a groove formed in the ring member.

Each aperture of the number of apertures may be disposed in the groove formed in the ring member.

The top surface of the ring member may be adapted to be disposed adjacent a material having a top surface of similar elevation and the top surface of the lid member may adapted to be disposed a distance above the top surface of the adjacent material. The top surface of the lid member may be adapted to be disposed at generally the same elevation as the top surface of the adjacent material.

The ring member may comprise a downward extending portion that is adapted to be disposed about the sump collar.

BRIEF DESCRIPTION OF THE DRAWINGS

A full understanding of the invention can be gained from the following description of the preferred embodiments when read in conjunction with the accompanying drawings in which.

Figure 1:
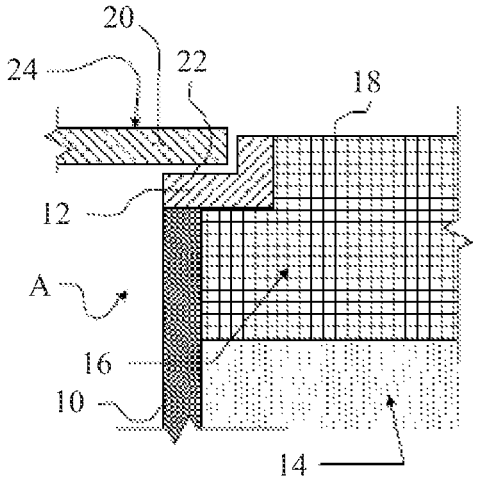
FIG. 1 shows a schematic cross sectional view of a portion of a prior art sump design.

It is to be appreciated that the figures described above are provided to increase understanding of the present invention and are not intended to be limiting upon the present invention.

DESCRIPTION OF THE PREFERRED EMBODIMENTS

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As employed herein, the term "number" shall mean one or an integer greater than one (i.e., a plurality) and the singular form of "a", "an", and "the" include plural referents unless the context clearly indicates otherwise.

Figure 2:
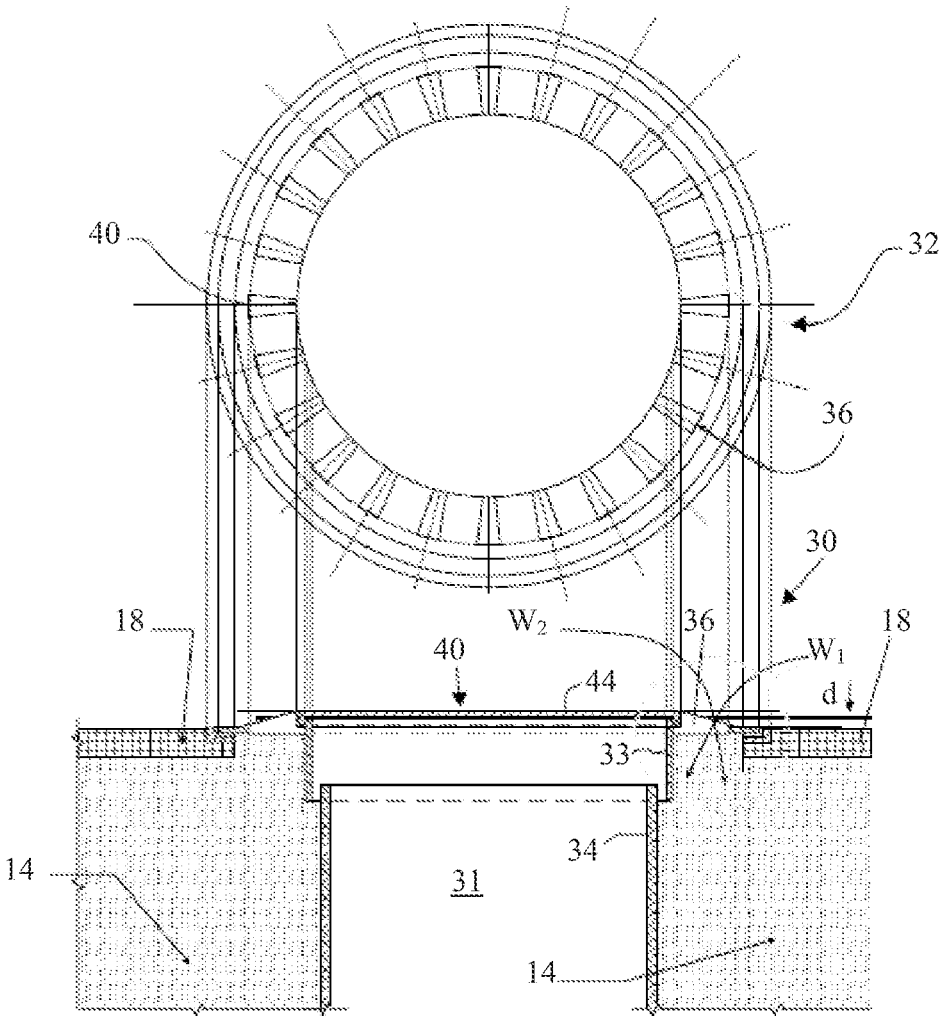
FIG. 2 shows a top view and a cross-sectional side view of an improved sump system in accordance with a non-limiting embodiment of the present invention.

Referring to FIG. 2, a top view and a cross-sectional side view of an improved sump system 30 in accordance with a non-limiting embodiment of the present invention is shown. The improved sump system 30 is designed to prevent the infiltration of water into the sump 31 while not hindering access to the sump 31. The improved sump system 30 is also designed to be readily retrofit to existing systems.

Continuing to refer to FIG. 2, the sump system 30 includes a ring 32, preferably formed from metal or other suitable rigid material, that is generally sized to fit around an existing sump collar 34, although a new sump collar or a collar formed integrally with the ring 32 could be used, depending on the application, without varying from the scope of the present invention. For example, as shown in the illustrated embodiment of FIGS. 2, 4 and 4A-B, ring 32 includes a downward extending collar portion 33 formed integrally therewith. Such collar portion may also be formed as a separate newly added member to an existing sump system or may be an existing portion of a sump collar to which a ring in accordance with the present invention, similar to ring 32, may be disposed around without varying from the scope of the present invention.

Figure 4:
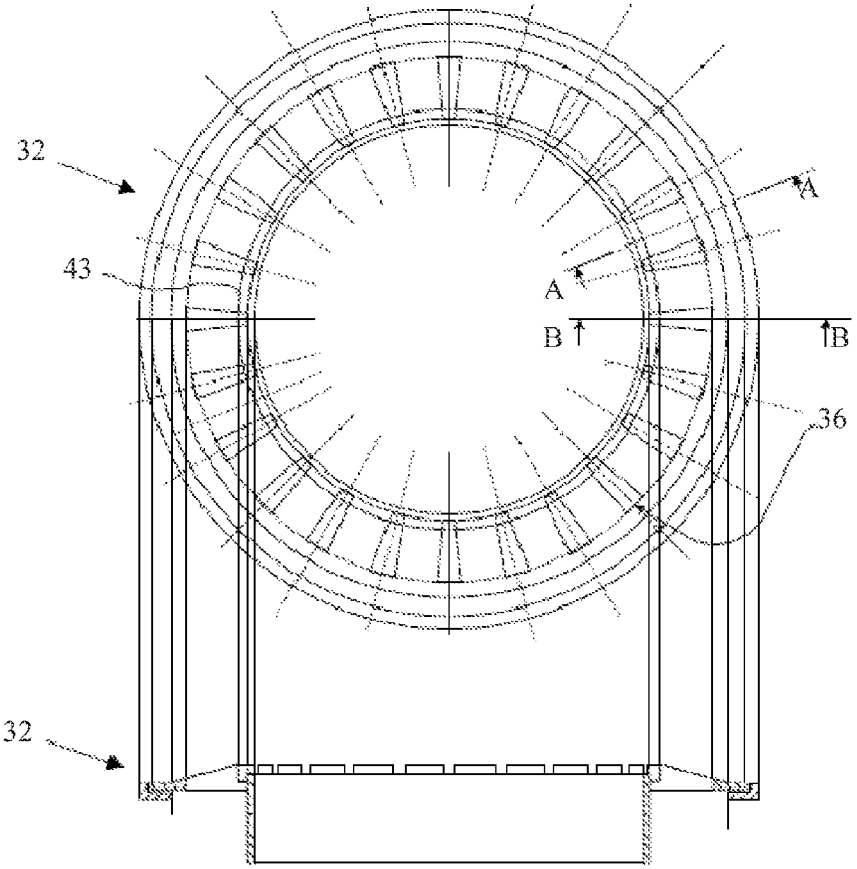
FIG. 4 shows a top and a cross-sectional view of the metal ring of the sump system of FIG. 2.
Figure 4A:
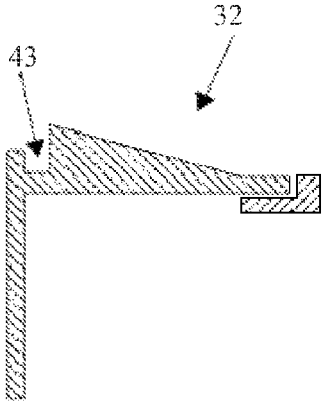
FIG. 4A shows a detail cross-sectional view of a portion of the metal ring of the sump system of FIG. 2 taken along line A-A of FIG. 4.
Figure 4B:
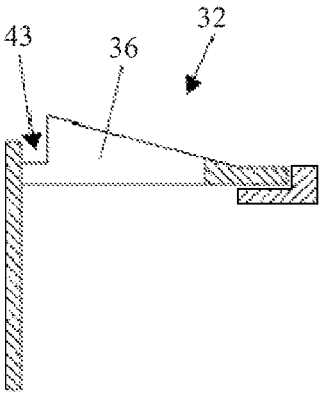
FIG. 4B shows a detail cross-sectional view of a portion of the metal ring of the sump system of FIG. 2 taken along line B-B of FIG. 4.

As shown in the top view of FIG. 2, and in greater detail in the views of FIGS. 4, 4A and 4B, ring 32 includes a number of holes or apertures 36 disposed therein, preferably at least somewhat evenly spaced about the ring 32. Each of the number of apertures 36 are positioned such that water or other liquid (as shown by the example arrow $W_1$) moving from the adjacent concrete 18 (FIG. 2) toward the sump opening (not numbered) is provided a flow path to drain into the gravel 14 below before getting to the sump opening. Hence, it is to be appreciated that each aperture 36 of the number of apertures provides a passage for liquid to pass from a top surface of ring 32 to a bottom surface by passing through ring 32.

Figure 3A:
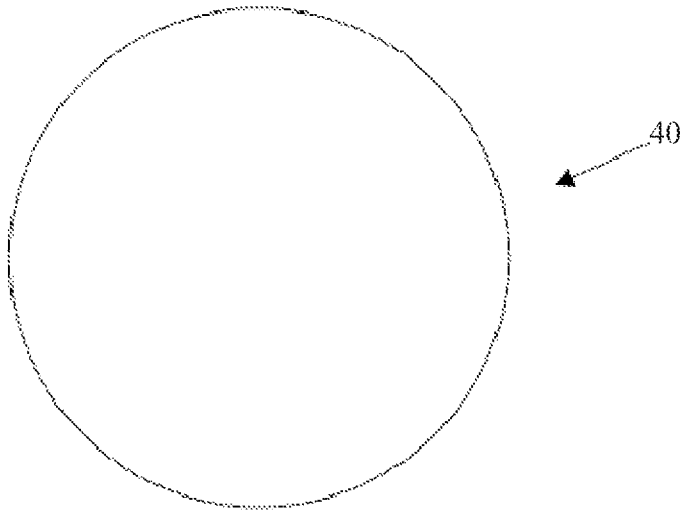
FIG. 3A shows a top view of the sump lid of the sump system of FIG. 2.
Figure 3B:
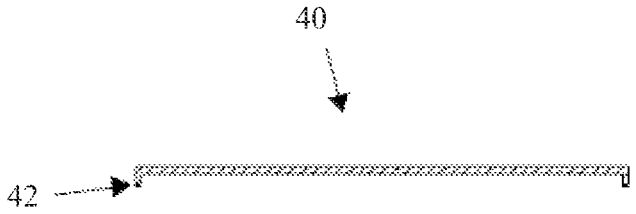
FIG. 3B shows a cross-sectional side view of the sump lid of the sump system of FIG. 2.

To further reduce the chance of water penetrating into the sump, the sump lid 40 may be provided with a downward extending lip 42 (FIG. 3B) that preferably interacts with a groove 43 (FIGS. 4 and 4A-B) formed or defined in a radially inner portion of ring 32, such as shown in FIG. 2. Such feature helps to ensure that any water or other liquid on top of the sump lid 40 (such as from rain or spills) does not enter the sump 31, but instead also flows toward and through the number of apertures 36 and into the gravel 14 below, such as shown generally by arrow $W_2$ in FIG. 2.

Figure 5:
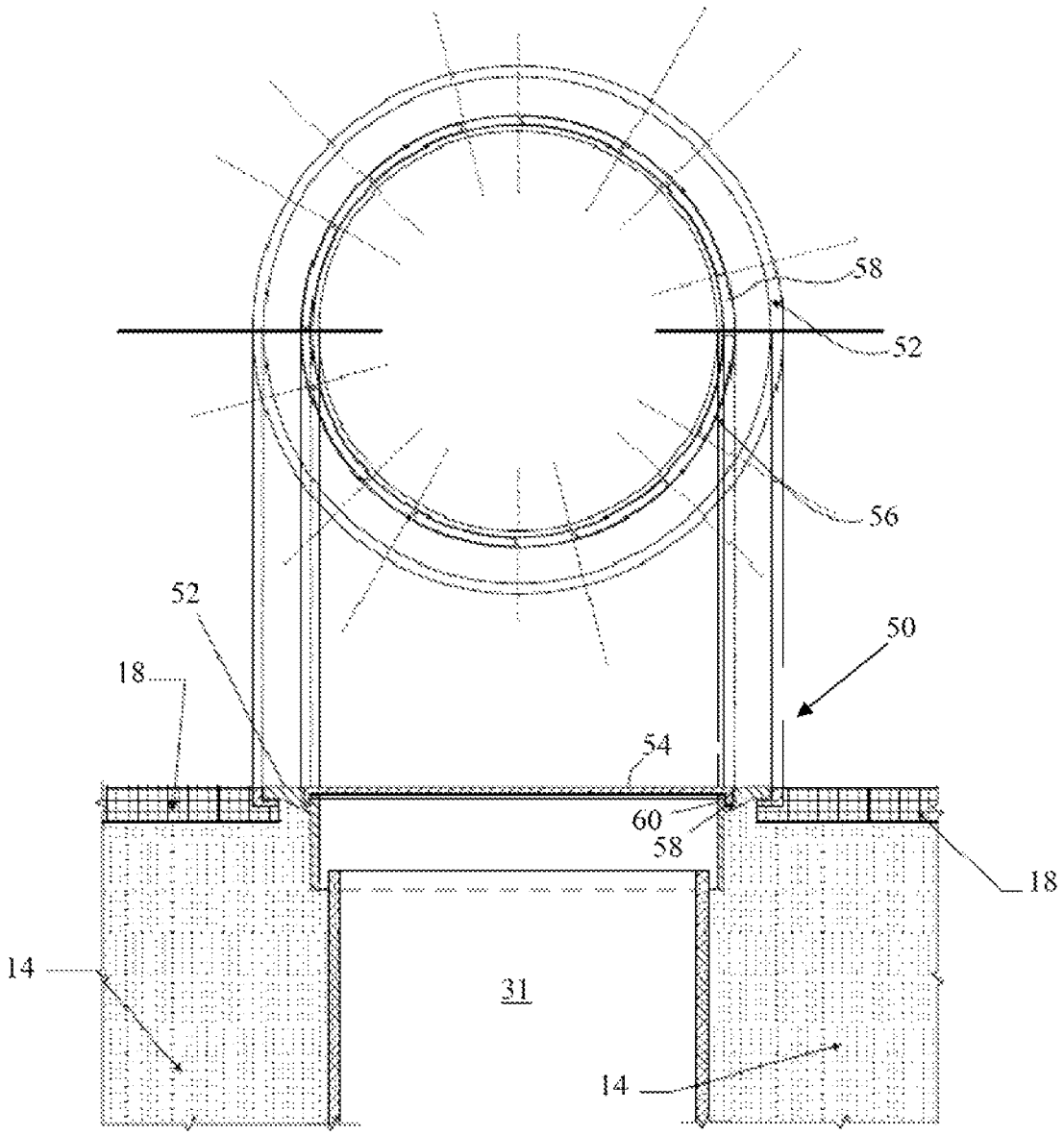
FIG. 5 shows a top view and a cross-sectional side view of an improved sump system in accordance with another non-limiting embodiment of the present invention.

As shown in FIG. 2, the top surface 44 of sump lid 40 is elevated a distance d above the top surface (not numbered) of the adjacent concrete 18. Such elevation is generally desirable in order to further decrease the likelihood of water penetrating the sump 31. However, in some applications, an elevated lid is not desirable, but instead a completely even or flush top surface is desired. FIG. 5 shows an another example embodiment of a sump system 50 in accordance with the present invention that provides such a flush surface.

Referring to FIG. 5, similar to the sump system 30 previously discussed in connection with FIGS. 2, 3A-B, 4 and 4A-B, the sump system 50 of FIG. 5 utilizes a ring 52 and lid 54 of preferably the same or similar construction as lid 40 previously discussed. Like the sump system 30 previously discussed, ring 52 could be used with an existing collar or could be formed having an integral collar. Unlike the sump system 30 previously discussed, the top (not numbered) of the ring 52 and lid 54 sit generally flush with the surrounding concrete 18. Additionally, unlike the sump system 30 previously discussed that utilized generally exposed drain holes 36, the embodiment shown in FIG. 5 utilizes a number of generally elongated holes or apertures 56 positioned generally under the edge (not numbered) of the sump lid 54 and formed in the bottom of a groove 58 which is engaged by a downward extending lip 60 of lid 54. Hence, it is to be appreciated that in such embodiment the sump lid 54 acts to keep debris from getting to, and potentially clogging the drain holes 56 and preventing water from draining to the gravel 14 beneath.

While example embodiments of the invention have been described, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A system for preventing liquid infiltration into a sump having an opening defined by a sump collar, the system comprising:

a ring member adapted to be disposed about the sump collar, at least a portion of the ring member adapted to be in communication with a drainable material disposed below; and a lid member in engagement with the ring member, wherein the ring member includes a number of apertures disposed therein, each aperture of the number of apertures being adapted to allow liquid to pass from a top surface of the ring member to the drainable material below, and wherein at least a portion of each aperture of the number of apertures is disposed in a portion of the ring member radially outward from the periphery of the lid member.

2. The system of claim 1 wherein the lid member comprises a downward extending lip that extends into and cooperatively engages a groove formed in the ring member.

3. The system of claim 2 wherein each aperture of the number of apertures is disposed in the groove formed in the ring member.

4. The system of claim 1 wherein the lid member has a top surface, wherein the top surface of the ring member is adapted to be disposed adjacent a material having a top surface of similar elevation, and wherein the top surface of the lid member is adapted to be disposed a distance above the top surface of the adjacent material.

5. The system of claim 1 wherein the lid member has a top surface, wherein the top surface of the ring member is adapted to be disposed adjacent a material having a top surface of similar elevation, and wherein the top surface of the lid member is adapted to be disposed at generally the same elevation as the top surface of the adjacent material.

6. The system of claim 1 wherein the ring member comprises a downward extending portion that is adapted to be disposed about the sump collar.

* * * * *